US007770550B2

(12) United States Patent
Tanabe et al.

(10) Patent No.: US 7,770,550 B2
(45) Date of Patent: Aug. 10, 2010

(54) VARIABLE VALVE TRAIN FOR AN INTERNAL COMBUSTION ENGINE

(75) Inventors: Mikio Tanabe, Obu (JP); Shinichi Murata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 252 days.

(21) Appl. No.: 12/076,719

(22) Filed: Mar. 21, 2008

(65) Prior Publication Data

US 2009/0007867 A1 Jan. 8, 2009

(30) Foreign Application Priority Data

Jul. 4, 2007 (JP) ..... 2007-176151

(51) Int. Cl.
*F01L 1/34* (2006.01)

(52) U.S. Cl. ..... 123/90.16; 123/90.31; 123/90.39; 74/569

(58) Field of Classification Search ..... 123/90.16, 123/90.27, 90.31, 90.39, 193.3, 193.5; 74/559, 74/567, 569; 464/102, 104
See application file for complete search history.

(56) References Cited

U.S. PATENT DOCUMENTS 5,421,780 A 6/1995 Vukovic
7,658,172 B2 * 2/2010 Tanabe et al. ..... 123/90.16

FOREIGN PATENT DOCUMENTS

DE 2544780 A1 4/1977
JP 2000-230567 A 8/2000
JP 2001-299015 A 10/2001
JP 2003-3811 A 1/2003

(Continued)

OTHER PUBLICATIONS

Hildebrand, "Feinmechanische Bauelemente", Precision-Mechanical Structural Members, 3rd Edition, pp. 615-619, 1978, Carl Hanser Verlag, Munich, Germany.

(Continued)

*Primary Examiner*—Ching Chang
(74) *Attorney, Agent, or Firm*—Birch, Stewart, Kolasch & Birch, LLP

(57) ABSTRACT

The invention provides a variable valve train for an internal combustion engine, in which attachment and detachment of a rotation drive source can be performed without an affect on a transmission mechanism and environment. The variable train system comprises a variable valve system that is fixed to a cylinder head and implements variable control on valve drive outputs according to displacement that is inputted to a control input member; a rotation drive source that outputs control rotation for setting valve properties from an output shaft; and a transmission mechanism that is located on the side of the variable valve system, receives the control rotation outputted from the output shaft with an input shaft, and transmits the control rotation to the control input member, wherein the rotation drive source is detachably fixed to an engine body; the output shaft of the rotation drive source is coupled to the input shaft by using a coupling that moves the output shaft toward the input shaft and disengageably couples the output shaft to the input shaft; and the coupling transmits the rotation of the output shaft to the input shaft while allowing misalignment between the output shaft and the input shaft.

7 Claims, 9 Drawing Sheets

FOREIGN PATENT DOCUMENTS

| | | | |
|---|---|---|---|
| JP | 2004-3419 | A | 1/2004 |
| JP | 2004-132515 | A | 4/2004 |
| JP | 2004-332549 | A | 11/2004 |
| JP | 2005-42642 | A | 2/2005 |
| JP | 2005-299536 | A | 10/2005 |

OTHER PUBLICATIONS

Rempke et al., "Mechanische Bauelemente Und Baugruppen", Mechanical Structural Members and Structural Units, 2nd Edition, 1981, pp. 91-93, VEB Verlag Technik, Berlin, Germany.

* cited by examiner

VARIABLE VALVE TRAIN FOR AN INTERNAL COMBUSTION ENGINE

BACKGROUND OF THE INVENTION

1. Field of the Invention

The present invention relates to a variable valve train for an internal combustion engine, which continuously controls valve drive outputs.

2. Description of the Related Art

A reciprocal engine (internal combustion engine) installed in an automobile is provided in its cylinder head with a variable valve train that at least continuously controls the valve properties of an intake valve for the purpose of addressing engine exhaust and improving pumping loss.

As a variable valve train of this type, a variable valve system is applied, in which at least a valve lift amount of the intake valve is continuously changed to allow an intake air amount. Many of the variable valve systems have a structure in which the valve drive outputs (valve lift amount, opening/closing timing, valve open duration, etc.) are continuously varied according to a swivel displacement that is inputted from a control shaft (see Unexamined Japanese Patent Publication No. 2005-299536, for example).

Inputs of the control shaft of the variable valve train are generally achieved through a structure in which the cylinder head is attached with an electric motor serving as a rotation drive source and a transmission mechanism for transmitting to the control shaft the control rotation that is outputted from an output shaft of the motor. Structures of variable valve trains include, for example, a structure in which a unit obtained by combining a ball screw shaft and an electric motor for driving the screw shaft is fixed to a cylinder head, and the control rotation of the motor is transmitted to a control shaft through a ball nut that is screwed onto the ball screw shaft (see Unexamined Japanese Patent Publication No. 2004-332549), a structure in which a unit obtained by combining a screw shaft and an electric motor for driving the screw shaft is fixed to a cylinder head, and the control rotation of the motor is transmitted to a control shaft through a link that is screwed onto the screw shaft (see Unexamined Japanese Patent Publication No. 2005-42642), etc.

A variable valve train is required to be easily repairable and replaceable. Particularly, an electric motor, being an important component of the variable valve train, preferably can be quickly repaired or replaced.

However, the electric motor of the variable valve train is installed in a transmission mechanism so as to be unmistakably positioned together with the ball screw shaft or the screw shaft(see Unexamined Japanese Patent Publications No. 2004-332549 and No. 2005-42642). For this reason, once the motor is removed from the transmission mechanism for repair or replacement, it is difficult to set up the motor again to be aligned with the axis of the ball screw shaft or of the screw shaft with high precision. Particularly if input shafts of the transmission mechanism, including the ball screw shaft and the screw shaft, are incorrectly positioned when the motor is placed back to the cylinder head after repair or for replacement, excessive friction is likely to be caused in sliding portions of the transmission mechanism. It is required for a variable valve train that continuously varies the opening/closing timing and the valve lift amount of an intake (or exhaust) valve to have high response in order to quickly and continuously implement variable control on the opening/closing timing and the valve lift amount according to an engine load state (operation state of an automobile). However, if the excessive friction is generated, it deteriorates the control response, and engine performance cannot be fully exerted. The excessive friction also influences the durability of the variable valve train.

One idea for solving this problem is to detachably fix the motor to a cylinder block as a separate body from the transmission mechanism, instead of forming a unit construction.

However, the bothersome axis alignment for aligning the axis of the output shaft of the motor with an input shaft of the transmission mechanism cannot be eliminated simply by making the motor detachable. It is then impossible to avoid a deterioration in response of control and an influence on the durability of the variable valve train.

Furthermore, the motors of the variable valve trains are located under the utilized transmission mechanisms (see Unexamined Japanese Patent Publications No. 2004-332549 and No. 2005-42642). Therefore, the detachment of the motors is likely to incur lubricating oil leakage, which generates environmental load.

SUMMARY OF THE INVENTION

It is an object of the invention to provide a variable valve train for an internal combustion engine, in which a rotation drive source can be attached and detached without affecting a transmission mechanism and environment.

In order to accomplish the above object, the variable valve train for an internal combustion engine according to the invention has a variable valve system that is fixed to a cylinder head and implements variable control on valve drive outputs according to displacement that is inputted to a control input member; a rotation drive source that outputs control rotation for setting valve properties from an output shaft; and a transmission mechanism that is located on the side of the variable valve system, receives the control rotation outputted from the output shaft with an input shaft, and transmits the control rotation to the control input member. The rotation drive source is detachably fixed to an engine body. The output shaft of the rotation drive source is coupled to the input shaft by using a coupling that moves the output shaft toward the input shaft and disengageably couples the output shaft to the input shaft. The coupling transmits the rotation of the output shaft to the input shaft while allowing misalignment between the output shaft and the input shaft.

According to the invention, because of the misalignment-allowing function of the coupling, even if the output shaft of the rotation drive source is misaligned with the input shaft of the transmission mechanism when the rotation drive source is installed again after being detached for repair or when the detached rotation drive source is replaced with a new rotation drive source, it is possible to couple the output shaft to the input shaft by using the coupling and to fasten a main body of the rotation drive source to the engine body. The misalignment-allowing function of the coupling also makes it possible to transmit the control rotation without causing excessive friction in the transmission mechanism even if the input and output shafts are misaligned with each other.

At the attachment/detachment of the rotation drive source for repair or replacement, if the rotation drive source is attached to the cylinder head with its axis misaligned, the control rotation is transmitted without causing excessive friction. As a result, variable response is retained. Consequently, there is no concern about an influence on the transmission mechanism. Moreover, high accuracy is not required in attachment/detachment of the rotation drive source, so that the rotation drive source can be easily installed. This improves assembling productivity and maintenance in the market.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

The present invention will be described below with reference to one embodiment shown in FIGS. 1 to 10.

Figure 1:
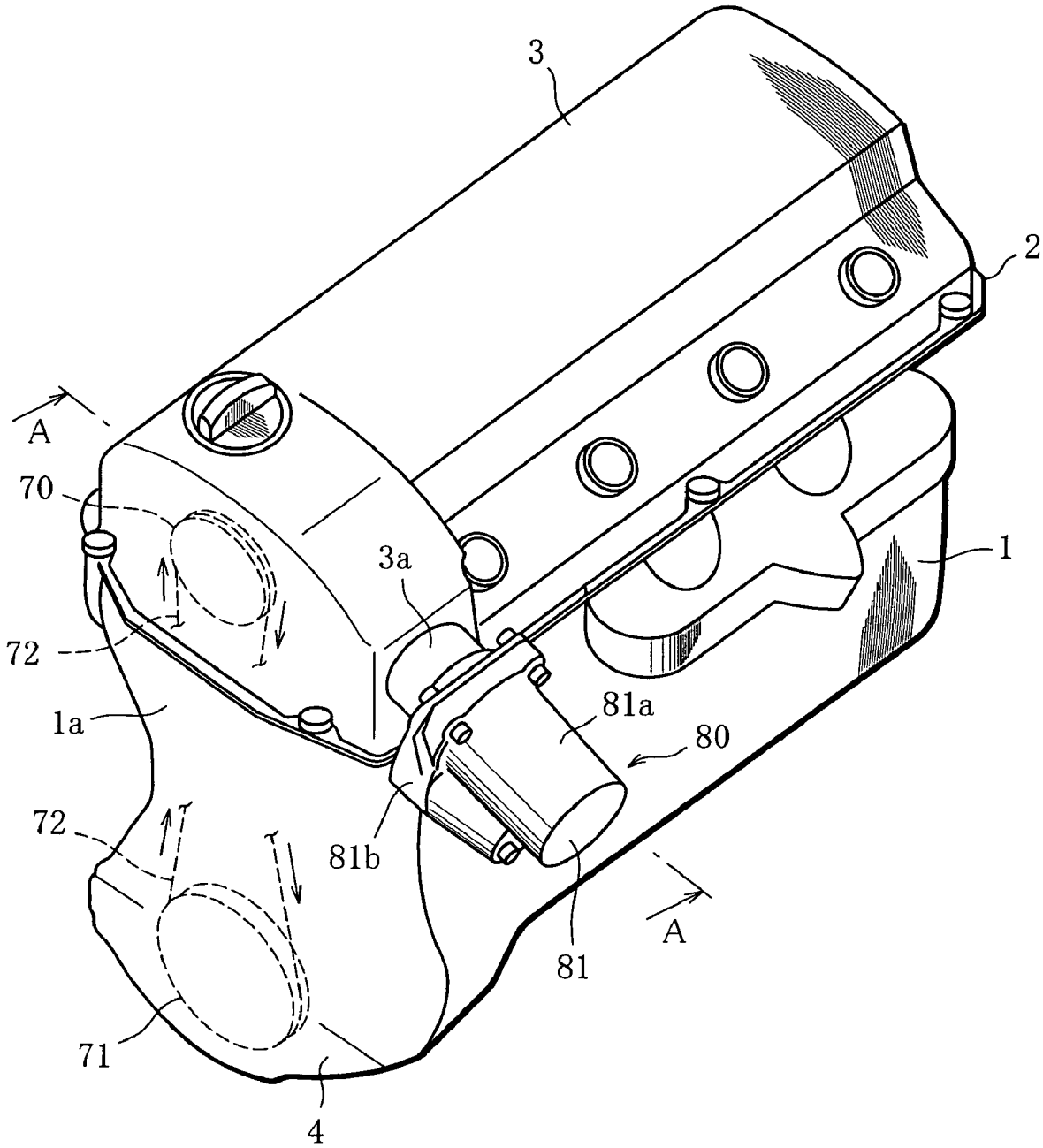
FIG. 1 is a perspective view of a main body of an internal combustion engine, for example, of an in-line-four-cylinder reciprocal gasoline engine.
Figure 2:
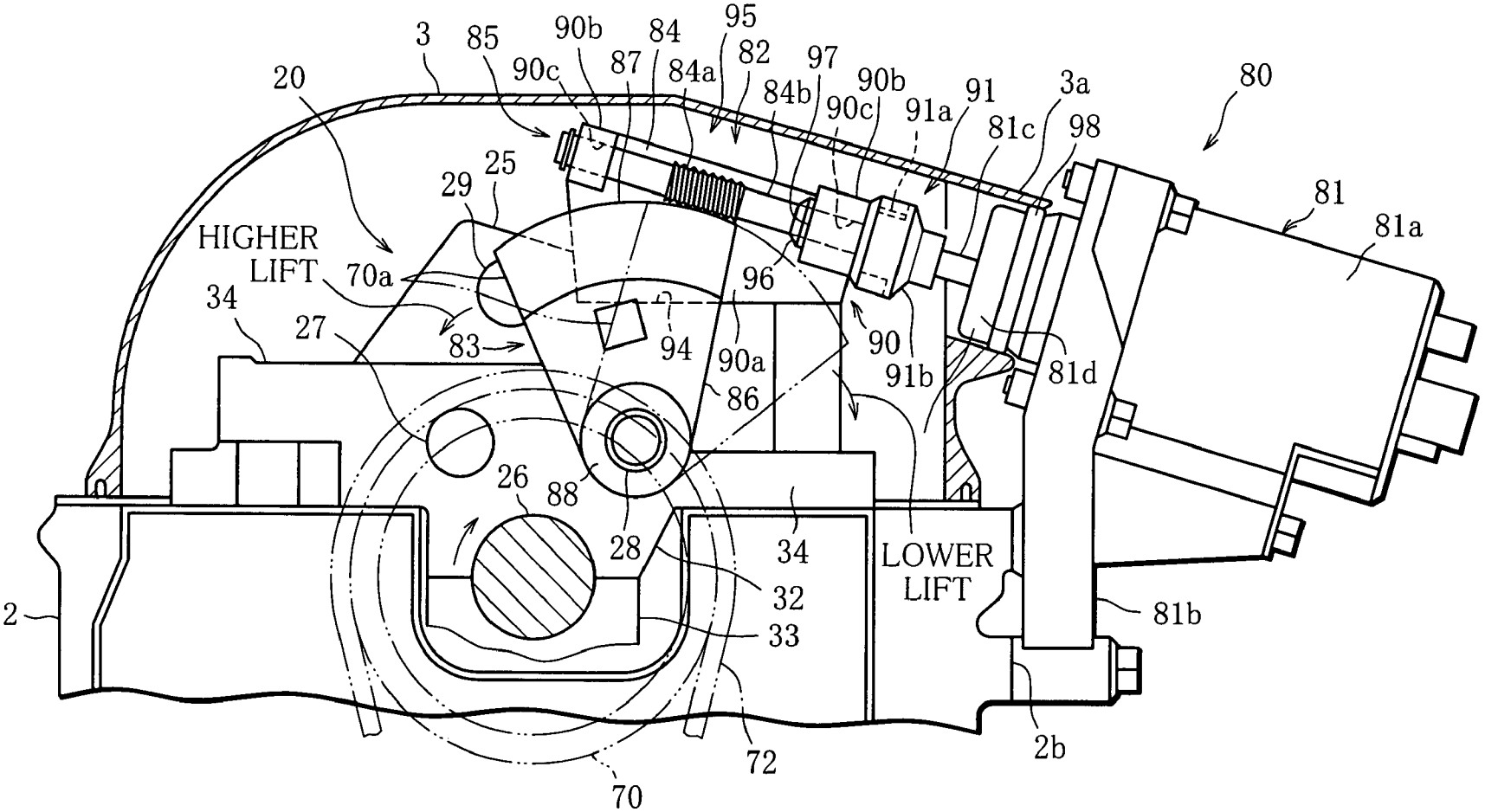
FIG. 2 is a sectional view, taken along line A-A of FIG. 1.
Figure 3:
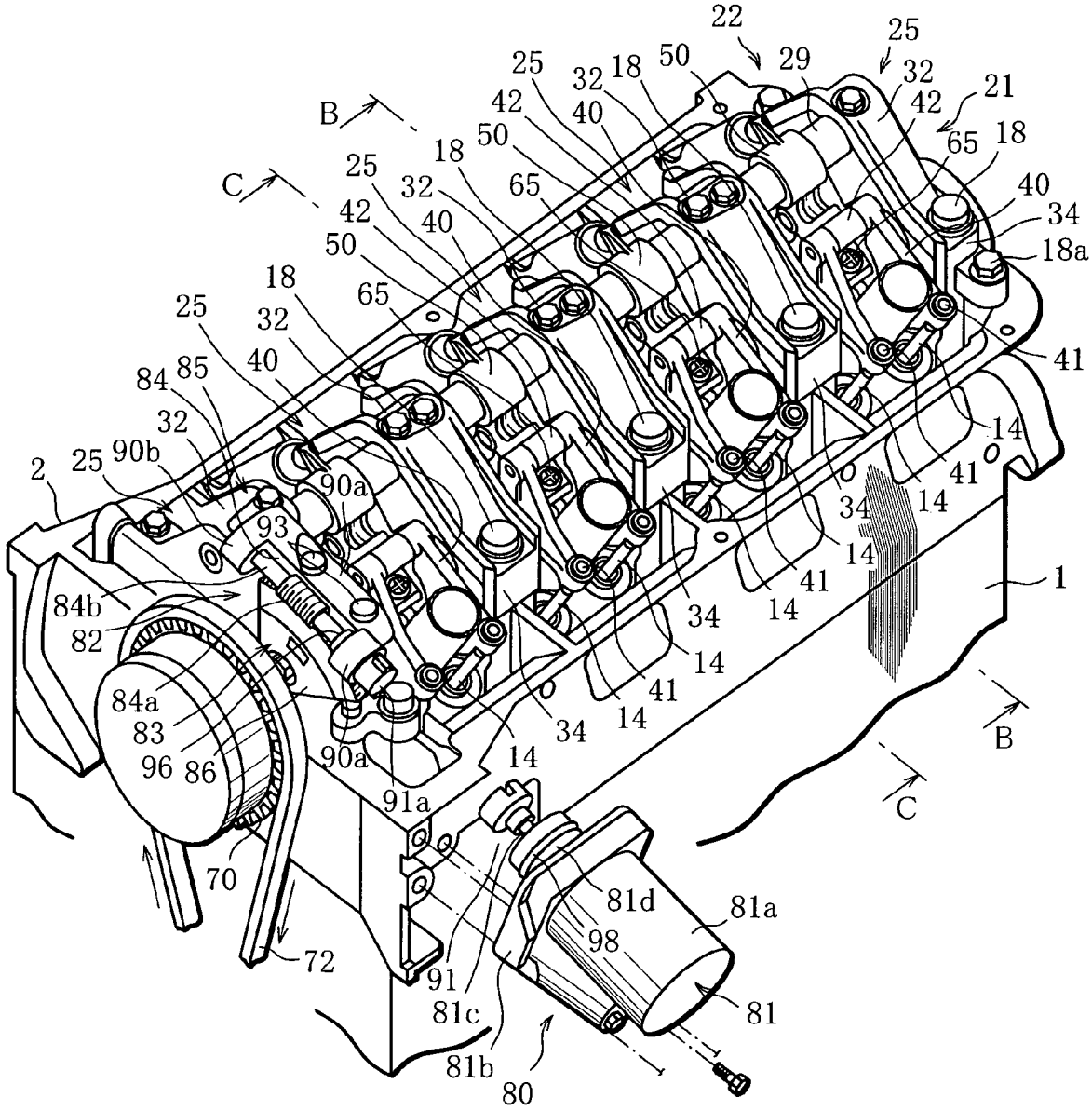
FIG. 3 is a perspective view of the engine from which a rocker cover and a timing chain cover shown in FIG. 1 are removed.
Figure 4:
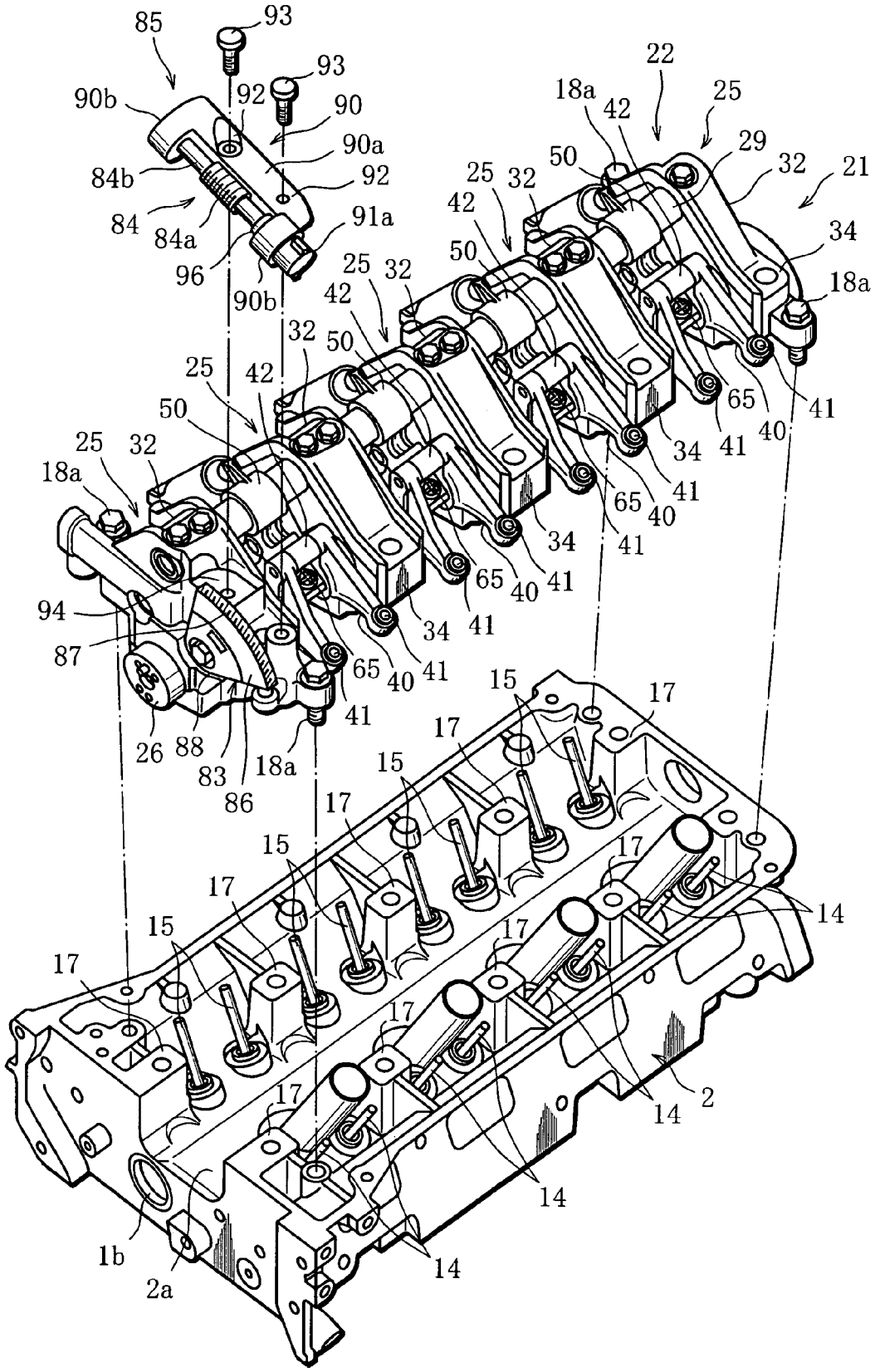
FIG. 4 is a perspective exploded view of the engine from which a valve operating system of FIG. 3 is removed.
Figure 5:
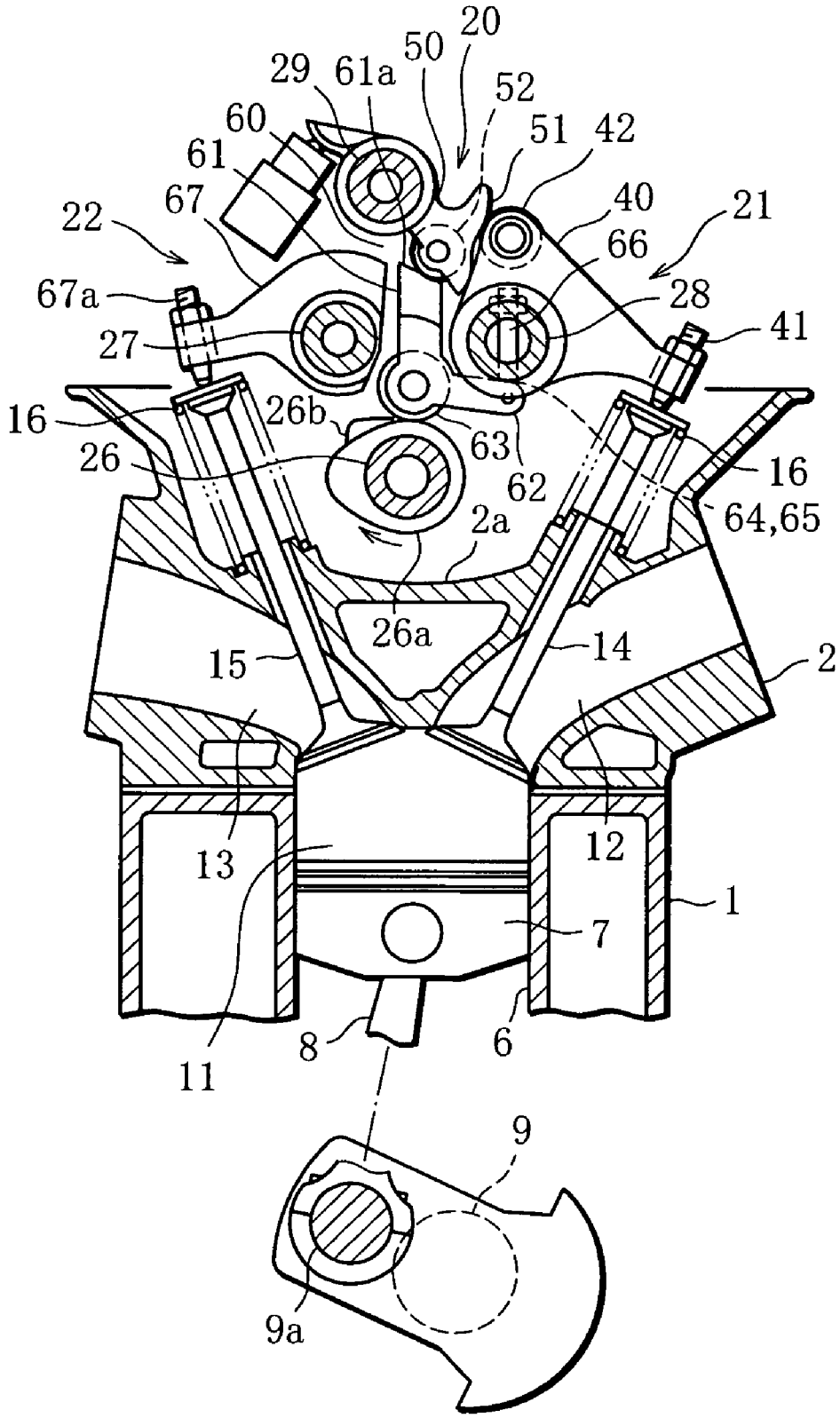
FIG. 5 is a sectional view of a variable valve train, taken along line B-B of FIG. 3.
Figure 6:
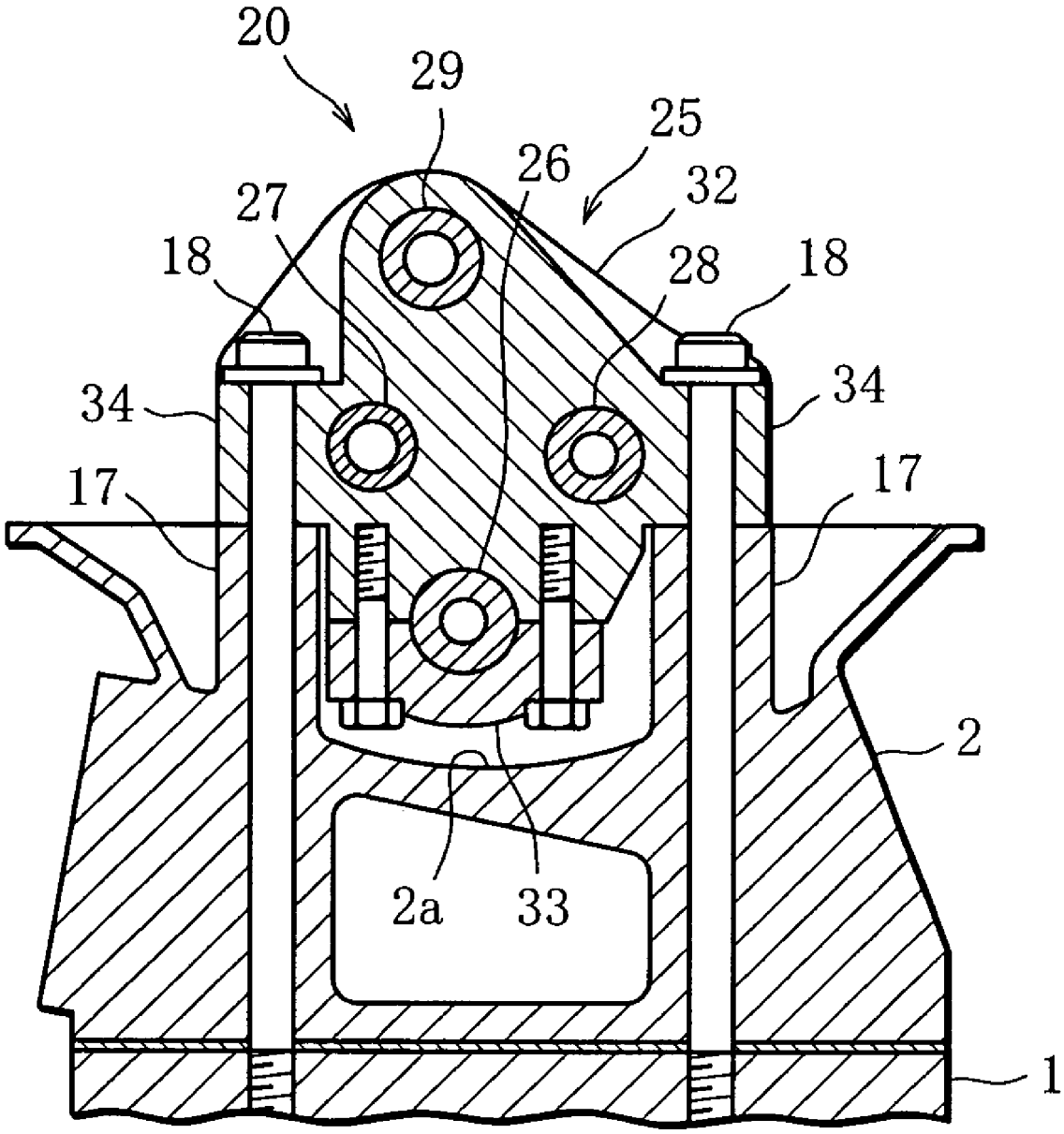
FIG. 6 is a sectional view of a variable valve train, taken along line C-C of FIG. 3.
Figure 7:
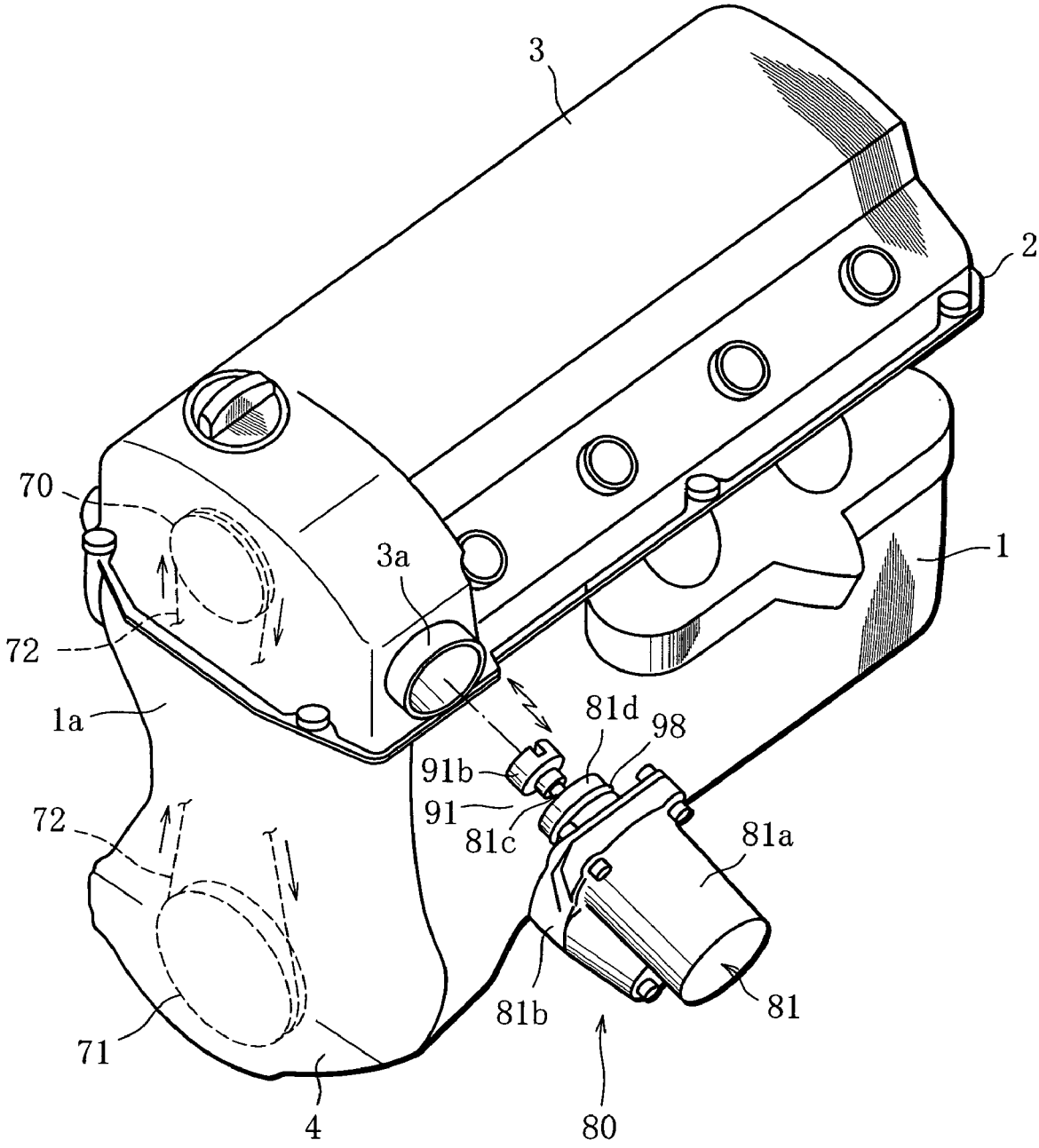
FIG. 7 is a perspective exploded view of the engine from which a rotation drive source is removed.
Figure 8:
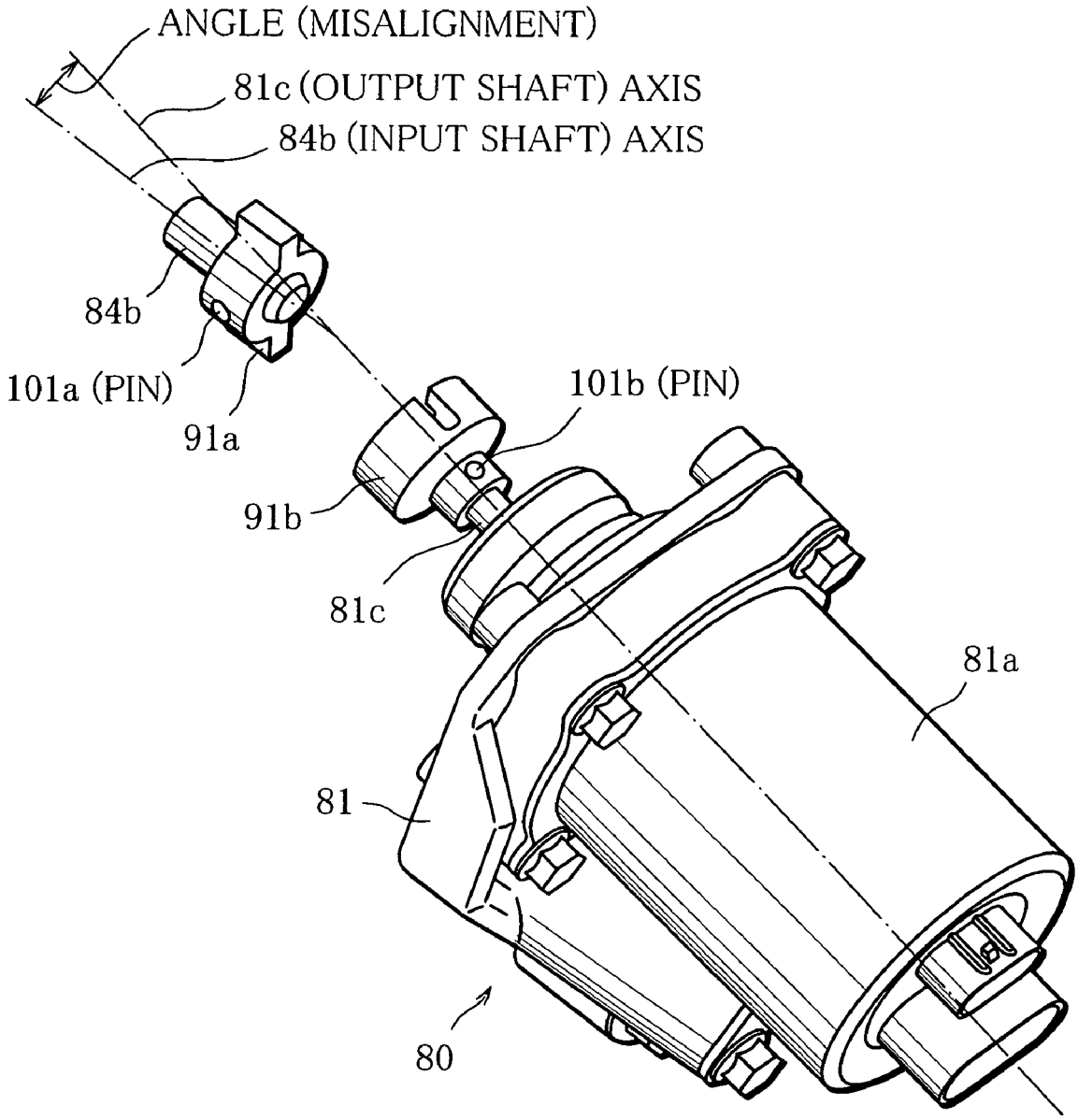
FIG. 8 is a perspective view of the rotation drive source in an enlarged scale.
Figure 9:
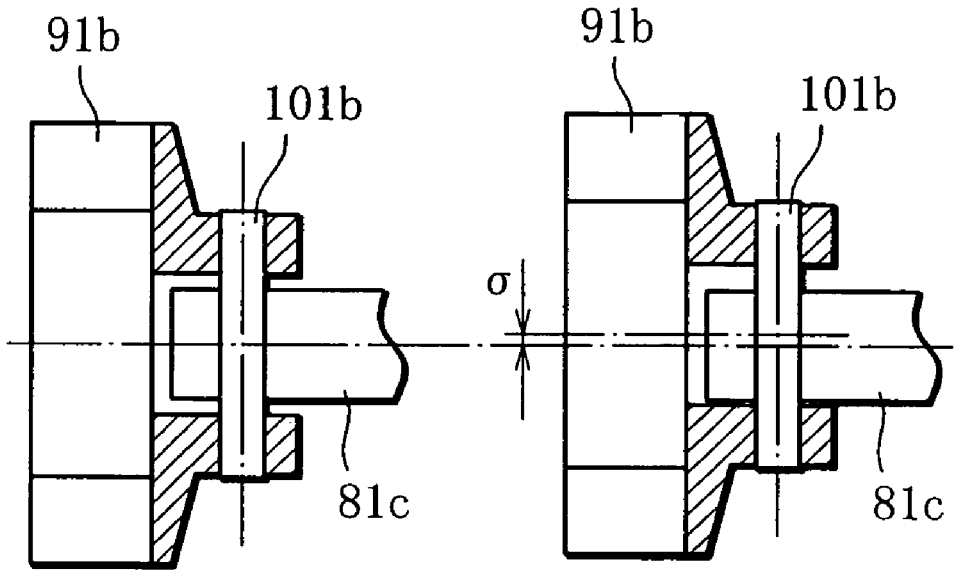
FIGS. 9 and 10 are sectional views of a coupling.
Figure 10:
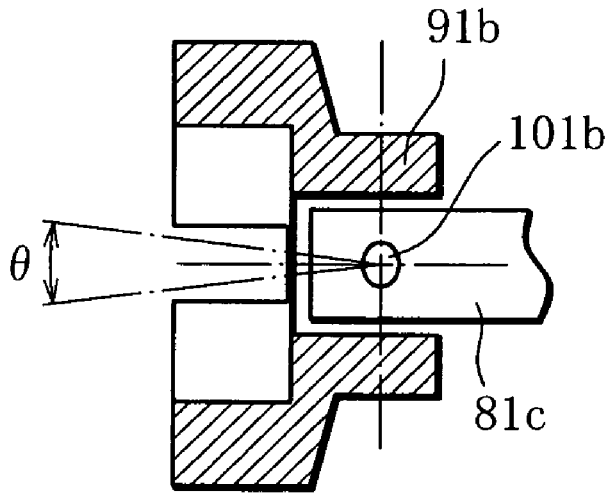

FIG. 1 is a perspective view of a main body of an internal combustion engine, for example, of an in-line-four-cylinder reciprocal gasoline engine. FIG. 2 is a sectional view, taken along line A-A of FIG. 1. FIG. 3 is a perspective view of the engine from which a rocker cover and a timing chain cover shown in FIG. 1 are removed. FIG. 4 is a perspective exploded view of the engine from which a valve operating system of FIG. 3 is removed. FIG. 5 is a sectional view of a variable valve train, taken along line B-B of FIG. 3. FIG. 6 is a sectional view of the variable valve train, taken along line C-C of FIG. 3. FIG. 7 is a perspective exploded view of the engine from which a rotation drive source is removed. FIG. 8 is a perspective view of the rotation drive source in an enlarged view. FIGS. 9 and 10 are sectional views of a coupling.

Reference numeral 1 in FIG. 1 denotes a cylinder block. Reference numerals 2, 3 and 4 represent a cylinder head mounted on the upper side of the cylinder block 1, a rocker cover that covers an upper portion of the cylinder head 2, and an oil pan that is disposed under the cylinder block 1, respectively. Reference numeral 1*a* is a timing chain cover that is set in a front portion of the cylinder block 1.

In the cylinder block 1, there are formed four cylinders 6, partially shown, to be arranged in an anteroposterior direction of the engine as illustrated in FIG. 5. Pistons 7 are accommodated in the respective cylinders 6 so as to be reciprocatable. The pistons 7 are coupled to crank shafts 9 arranged in an anteroposterior direction of the cylinder block 1 with crank pins 9*a*. The reciprocation transmitted from the pistons 7 is outputted to the crank shafts 9 while being converted to rotational movement.

Under the cylinder head 2, combustion chambers 11 are formed correspondingly to the four cylinders 6 as illustrated in FIG. 5. On both sides of each of the combustion chambers 11, there are formed a pair of intake ports 12 and a pair of exhaust ports 13 (only one of each pair is illustrated). In the center of the upper side of the cylinder head 2, there is a recession extending in an anteroposterior direction. Both sides of a recessed portion 2*a* are protruding in lateral directions. On the both sides of each of the combustion chambers 11, an intake valve 14 for opening and closing the intake port 12 and an exhaust valve 15 for opening and closing the exhaust port 13 are provided to each of the cylinders 6. Both the intake valve 14 and the exhaust valve 15 are normally-closed valves that are biased in a closing direction by a valve spring 16, shown only in FIG. 5.

A variable valve train 20 that is constructed into an SOHC-type valve train as shown in FIGS. 2 to 6 is mounted on the recessed portion 2*a* formed in the upper side of the cylinder head 2. The variable valve train 20 is accommodated in a rocker cover 3. The variable valve train 20 has a structure in which the camshaft 26, a variable valve system 21 that continuously varies the valve properties of the intake valve 14, and a rocker arm system 22 that opens and closes the exhaust valve 15 are at fixed timing integrated into one unit.

To explain the variable valve train 20 with reference to FIGS. 1 to 6, reference numerals 25, 26, 27, 28 and 29 represent a holding member, camshaft, an exhaust rocker shaft, a control shaft that doubles as an intake rocker shaft, and a support shaft, respectively. The shafts 26 to 29 are made of shaft members extending in the anteroposterior direction of the engine. In the camshaft 26, there is formed a cam group including three cams, such as an intake cam 26*a* and a pair of exhaust cams 26*b*, partially shown in FIG. 5, which are placed on both sides of the intake cam 26*a*, with respect to each cylinder as shown in FIG. 5.

The holding members 25 are disposed in respective places on the upper side of the cylinder head 2, and more particularly, for example, in the forefront of a cylinder line, between the cylinders, and the aftermost of the cylinder line. The holding member 25 is constructed by combining a holder 32 and a cap 33 that is fitted to a lower end of the holder 32 as illustrated in FIG. 6. The camshaft 26 is rotatably supported in a position sandwiched between a journal surface formed in a lower end face of the holder 32 and a journal surface formed in an upper face of the cap 33. The control shaft 28 is rotatably supported on the intake side (one side in a width direction) of a middle of the holder 32. The exhaust rocker shaft 27 is fixed on the exhaust side (the other side in the width direction) that is opposite to the control shaft 28 located in the middle of the holder 32. The support shaft 29 is fixed in an upper side of the holder 32. On both sides of the holder 32, a pair of fixing seats 34 is formed so as to be positioned near the exhaust rocker shaft 27 and the control shaft 28 as illustrated in FIG. 6. With the above construction, a frame that can be mounted on the cylinder head 2 is obtained.

The frame is fitted with the variable valve system 21 and the rocker arm system 22 with respect to each cylinder. The variable valve system 21 has a structure in which a rocker arm 40, a swing cam 50 and a center rocker arm 60 are combined with each other, for example, as illustrated in FIG. 5.

As illustrated in FIGS. 3 and 4, a two-way arm member is used as the rocker arm 40. A center portion of the arm member is swivelably supported by the control shaft 28 as illustrated in FIG. 5. An adjust screw 41 disposed in an end portion of the arm member is protruding in a lateral direction of the frame. A needle roller 42 disposed in a base end portion of the arm member is located on the side of the support shaft 29.

As shown in FIGS. 3 to 5, one end portion of the swing cam 50 is swivelably supported by the support shaft 29, and the other end portion is formed of a swing cam member that is protruding toward the needle roller 42 of the rocker arm 40. A cam surface 51 formed in a surface of the other end portion comes into rotational contact with the needle roller 42. A sliding roller 52 is rotatably installed in a lower portion of the swing cam member.

The center rocker arm 60 is disposed in a place surrounded by the intake cam 26*a*, the control shaft 28, and the sliding roller 52 as illustrated in FIG. 5. The center rocker arm 60 is formed into the shape of letter L with an arm portion 61 extending toward the sliding roller 52 located above and an arm portion 62 extending beneath the control shaft 28 located on the side of the center rocker arm 60. An inclined surface 61*a* (for example, a control-shaft side is low, and a support-shaft side is high) that is formed in an end face of the arm portion 61 comes into rotational contact with the sliding roller 52 of the swing cam 50. The sliding roller 63 that is supported by an intersecting part of the arm portions 61 and 62 is brought into rotational contact with a cam surface of the intake cam 26*a* so that cam displacement of the intake cam 26*a* which acts as valve drive outputs is outputted through the arm portion 61 to the swing cam 50. A pin 64 that is swivelably supported by an end of the arm portion 62 is swivelably inserted into a through hole 65 that is formed in the control shaft 28. As a result of this insertion, the center rocker arm 60 is oscillatably supported by using a swivel point located at the end of the arm portion 26 as a supporting point. Because of this integral construction of the center rocker arm 60, when the control shaft 28 makes a swivel displacement, the center rocker arm 60 is displaced in a direction intersecting with the cam shaft 26 (timing advance or retard direction) while changing a rotational contact point with the intake cam 26*a*.

As a result of this displacement, the valve drive outputs that are outputted from the center rocker arm 60, including a valve lift amount and opening/closing timing of the intake valve 14, are continuously varied at the same time. An upper portion of the cam surface 51 is a base circle zone corresponding to a base circle of the intake cam 26*a*, and a lower portion of the cam surface 51 is a lift zone (corresponding to a cam shape of a lift area of the intake cam 26*a*) that continues to the base circle zone. Therefore, if the sliding roller 63 of the center rocker arm 60 is displaced in the timing advance or retard direction of the intake cam 26*a*, the position of the swing cam 50 is changed. An area of the cam surface 51, in which the needle roller 42 is oscillated, is accordingly changed. In short, a ratio between the base zone and the lift zone, in which the needle roller 42 is oscillated, is changed. By using a change in ratio between the base and lift zones, which is accompanied by phase changes in the timing advance and retard directions, the valve lift amount of the intake valve 14 is continuously varied from a low valve lift amount that is resulted by the cam shape of the top of the intake cam 26*a* to a high valve lift amount that is resulted by the cam shape of an area extending from the top to the base end of the intake cam 26*a*. At the same time, the opening/closing timing of the intake valve 14 is varied more greatly in valve-closing timing than in valve-opening timing.

A screw member 66 for adjusting a protrusion amount of the pin 64 is screwed into the through hole 65 so as to be movable in advancing and retreating directions (for adjustment of the valve-opening/closing timing and the valve lift amount with respect to each cylinder).

The rocker arm system 22 (exhaust side) has a pair of rocker arms 67 as shown in FIG. 5 (only one of the pair is illustrated). The rocker arms 67 are located on both sides of the center rocker arm 60 and are swivelably supported by the exhaust rocker shaft 27. A roller member, not shown, located in one end is brought into rotational contact with the cam surface of the exhaust cam 26*b*. An adjust screw portion 67*a* located in the other end is protruding in a lateral direction of the frame.

Because of the above-described configuration, the cam shaft 26, the variable valve system 21, and the rocker arm system 22 are integrated into one entity. Each of the fixing seats 34 of the unitized variable valve train 20 is arranged in a boss portion 17 protruding from a bottom face of the recessed portion 2*a* (cylinder head 2) as illustrated in FIGS. 4 and 6. Each of the fixing seats 34 is fastened together with the cylinder head 2 with a cylinder head bolt 18 that is screwed into the cylinder block 1 through the fixing seat 34 and the cylinder head 2 as illustrated in FIGS. 3 and 6. Namely, the variable valve train 20 is fastened by using the cylinder head bolt 18 having high supporting strength (as the cylinder head bolt 18 is required to have quality that is bearable against explosion pressure applied to the cylinder head 2, the cylinder head bolt 18 has higher rigidity than other bolts). Particularly, the variable valve train 20 is fastened at points near the exhaust rocker shaft 27 and the control shaft 28 so as to be firmly fastened. The holding members 25 located at the forefront and aftermost are fastened to the cylinder head 2 with additional fastening bolts 18*a* as well.

By mounting the variable valve train 20 in the above-described manner, the adjust screw 41 of the rocker arm 40 (for intake) is located at the end of a stem of the intake valve 14 that is fixed to the cylinder head 2, and the adjust screw 67*a* of the exhaust rocker arm 67 is located at the end of a stem of the exhaust valve 15 that is fixed to the cylinder head 2, as illustrated in FIG. 5. Reference numeral 68 is a pusher that is combined with the swing cam 50. The pusher 68 is a component for pushing the center rocker arm 60 against the intake cam 26*a* through the swing cam 50.

One end portion of the cam shaft 26 is protruding frontward through a penetrated portion 1*b* formed in an end wall surrounding the recessed portion 2*a* of the cylinder head 2, for example, as illustrated in FIG. 4. A cam sprocket 70 that is a timing component, is fitted with this protruding end portion of the cam shaft 26, as illustrated in FIGS. 1 to 3. A timing chain 72 is hung between the cam sprocket 70 and a crank sprocket 71 that is set in one end portion of a crank shaft 9, whereby the cam shaft 26 is rotated by crank output.

As illustrated in FIG. 3, in the forefront of the cylinder head 1, there is disposed a drive unit 80 for driving the control shaft 28. The drive unit 80 has a structure in which an electric motor 81 serving, for example, as a rotation drive source, and a transmission mechanism that is a separate body from the electric motor 81, for example, a worm gear reduction mechanism 82 are combined with each other. The worm gear reduction mechanism 82 is set in between the cylinder head 2 and the rocker cover 3 together with the variable train system 21. The worm gear reduction mechanism 82 is formed by combining, for example, a fan-shaped worm wheel gear 83 and a worm shaft gear 84 to be engaged with the worm wheel gear 83. A portion including the worm shaft gear 84 is unitized as a worm shaft gear unit 85 that is a separate body from the worm wheel gear 83.

The fan-shaped worm wheel gear 83 is made of a plate-like component having a large number of gear portions 87 in an outer circumferential edge of a fan-like plate body 86 and a mounting seat 88 in a swiveling center as illustrated in FIGS.

3 and 4. The mounting seat 88 of the fan-like component is fastened to a shaft end of the control shaft 28 serving as a control input member protruding frontward from the holder 32 (holding member 25) located at the forefront, and the gear portions 87 are arranged above the cylinder head 2.

The worm shaft gear unit 85 has a frame 90, for example, as illustrated in FIGS. 2 and 4. The frame 90 includes a base 90*a* extending in a width direction of the cylinder head 2 and a pair of arms 90*b* extending from both end portions of the base 90*a* in an anteroposterior direction of the cylinder head 2. In end portions of the arms 90*b*, there are formed bearing surfaces 90*c* as shown in FIG. 2. As the worm shaft gear 84 functioning as an input shaft of the worm gear reduction mechanism 82, a shaft portion 84*b* having a worm gear portion 84*a* in the middle is used. Both end portions of the shaft portion 84*b* are rotatably supported by the respective bearing surfaces 90*c*, and the worm gear portion 84*a* is located between the bearing surfaces 90*c*. One end of the shaft portion 84*b* is protruding from the arm 90*b*. A first coupling member 91*a* constructs a coupling 91 having an Oldham's coupling function that allows misalignment between the shafts without preventing the rotation of one of the shafts from being transmitted to the other shaft as shown in FIGS. 8 to 10. The first coupling member 91*a* is attached to a shaft end portion of the protruding shaft portion 84*b* with a pin 101*a* orthogonal to the axis of the shaft portion 84*b* so as to be capable of making offset movement σ and oscillation θ with respect to an axis of the shaft portion 84*b*. The coupling 91 has the first coupling member 91*a* and a second coupling member 91*b* that can be engaged with the first coupling member 91*a*. The relationship among the first coupling member 91*a*, the pin 101*a* and the input shaft 84*b* is the same as the relationship among the second coupling member 91*b*, the pin 101*b* and the input shaft 81*c* as described later in detail with reference to FIGS. 9 and 10. The first coupling member 91*a* and the second coupling member 91*b* can be relatively and slightly displaced in an axial direction even when the first and second coupling members 91*a* and 91*b* are coupled with each other. In both end portions of the base 90*a*, there are formed installation seats 92 for mounting the variable train system 21 on the cylinder head 2 through the holder 32 (holding member 25) holding the variable train system 21, which is located at the forefront.

The installation seats 92 are disposed on a receiving seat 94 that is formed in the upper side of the holder 32 (holding member 25) located at the forefront, that is, a portion located above the control shaft 28, by using a fastening bolt 93 as illustrated in FIG. 4. In this manner, the worm shaft gear unit 85 is mounted on the cylinder head 2 to face sideways. At the same time as the mounting, the worm shaft gear 84 is engaged with the worm wheel gear 83 as illustrated in FIG. 2. Particularly, the worm shaft gear unit 85 is installed in a position inclining toward the cylinder head 2 so that the coupling 91 side is lower than an engagement portion 95 in which the worm shaft gear 84 and the worm wheel gear 83 are engaged with each other. Control rotation that is inputted from the first coupling member 91*a* of the coupling 91 (rotation that determines required valve properties, such as a valve lift amount and opening/closing timing) is transmitted through the engagement portion 95 of the gears 83 and 84 to the control shaft 28. For example, when the worm wheel gear 83 makes a swivel displacement toward the exhaust rocker shaft 27 as shown by an arrow in FIG. 2, control rotation for directing the gear 83 to a high valve lift side is transmitted to the control shaft 28. To the contrary, when the worm wheel gear 83 makes a swivel displacement toward the coupling 91, control rotation for directing the gear 83 to a low valve lift side is transmitted to the control shaft 28.

Due to the configuration of components of the variable train system 21, the control shaft 28 is set so that a valve reaction force (spring reaction force) transmitted from the variable train system 21 acts only in one rotating direction, for example, in a low-valve-lift direction. The worm shaft gear 84 is therefore applied with the valve reaction force only in one axial direction. To receive the valve reaction force, a thrust receiving portion 96 is disposed in a shaft portion located on the side of the coupling 91. More concretely, the thrust receiving portion 96 is formed in a flange-like shape and is arranged adjacently to the arm 90*b* located on the side of the coupling 91. The thrust receiving portion 96 is slidably received by a thrust surface 97 (shown in FIG. 2) that is formed in the arm 90*b*. By so doing, a thrust force created by the valve reaction force is not transmitted to the coupling 91 side.

Directions of gear teeth, in which the worm wheel gear 83 and the worm shaft gear 84 are engaged to each other, are set to be an oblique direction that produces a force acting to make the worm wheel gear 83 move toward the holding member 25 by using the valve reaction force. Accordingly, the control shaft 28 is applied with the thrust force only in one axial direction. The thrust force (one direction) acting on the control shaft 28 is received by a receiving structure that is constructed of, although not shown, one end of the control shaft 28, for example, a thrust surface formed in an end located on the side of the worm wheel gear 83, and a thrust receiving portion formed in a front face of the holder 32 (holding member 25) arranged at the forefront.

The worm wheel gear 83 is installed with a backlash spring member, not shown, for suppressing backlash caused in the engagement portion 95 where the worm wheel gear 83 and the worm shaft gear 84 are engaged with each other. The spring member is so installed as to be applied with a force acting to press teeth surfaces of the gear portions 87 of the worm wheel gear 83 against teeth surfaces of the worm gear portion 84*a* of the worm shaft gear 84, for example, only in an area of a zone of the high valve lift amount except for the low valve lift amount in an area where the valve lift amount of the intake valve 14 is continuously varied. By using the backlash spring member, backlash is suppressed according to conditions in a high-valve-lift period where high gear rattle is likely to be caused and a low-valve-lift period where high gear rattle is not likely to be caused.

Unlike the worm shaft gear unit 85 that is unitized as described above, the electric motor 81 is made of an electric motor body 81*a* constructed by combining a conventional rotor and a conventional stator, not shown, as illustrated in FIGS. 2 and 3. In other words, as the electric motor 81, the electric motor body 81*a* that has a column-like insert portion 81*d* in an output-side end and is attached with a mounting bracket 81*b* (corresponding to a fixed portion of the invention) in a body portion. A motor shaft 81*c* of the electric motor body 81*a* extends frontward, piercing the center of the insert portion 81*d*. This motor shaft portion extending frontward is used as an output shaft 81*c*. The second coupling member 91*b* of the coupling 91 is attached to an end of the output shaft 81*c* with a pin 101*b* orthogonal to an axis of the output shaft 81*c* as illustrated in FIGS. 8 to 10, so as to be capable of making offset movement σ and oscillation θ with respect to the axis of the output shaft 81*c*. By arranging the pin 101*a* and the pin 101*b* in positions substantially orthogonal to each other, directions of the offset movement σ and oscillation θ are also substantially orthogonal to each other. This makes it possible to allow offset misalignment and/or angular misalignment between the axes of the output shaft 81*c* and the input shaft 84*b*. It is further possible to allow the misalignments if the direction of engagement between the first and second coupling members 91*a* and 91*b* of the coupling 91 is set at an angle with the directions of the pins 101*a* and 101*b*.

The insert portion 81*d* has such a shape that the insert portion 81*d* can be inserted into a cylindrical insert opening 3*a* that is formed in a lateral wall of the rocker cover 3 as illustrated in FIGS. 1 and 2. In short, the insert portion 81*d* can be inserted into the insert opening 3*a* from the outside of the rocker cover 3. The insert opening 3*a* is located in a fore part of the first coupling member 91*a* of the worm shaft gear unit 85 and is inclined downward correspondingly to the inclination of the worm shaft gear 84. Consequently, when the insert portion 81*d* is inserted from the insert opening 3*a*, the second coupling member 91*b* located in the fore part is directed to a point where the second coupling member 91*b* is engaged with the first coupling member 91*a* located in the end of the worm shaft gear (end of the input shaft) by using the insert opening 3*a* as a guide. In other words, the coupling 91 is connected by inserting the insert portion 81*b* into the insert opening 3*a*. A range in which the second coupling member 91*b* makes the offset movement σ and the oscillation θ in relation to the axis of the output shaft 81*c* is restricted due to the configuration. Therefore, the insertion can be carried out without any trouble. The first coupling member 91*a* is also attached in the same manner in relation to the axis of the worm shaft.

Since the coupling portion is provided with the functions of offset movement and oscillation, even if the axis of the output shaft 81*c* is misaligned with that of the worm shaft or if the axes are arranged at an angle, the installation is carried out without difficulty, and the rotation is reliably transmitted. If there is a misalignment, a minor slip is caused in the coupling portion. Although there is no particular oil-feeding function, the coupling portion is continuously supplied with scattered oil from the timing chain 72 and the valve train since the coupling portion is located in the inside of the rocker cover 3. This prevents friction and abrasion which are caused by the slip.

The mounting bracket 81*b* is made of an L-shaped bracket member that can be attached to and detached from a motor mounting face 2*b* formed in a lateral portion of the cylinder head 2 as illustrated in FIG. 2. After the connection of the coupling 91 is finished, the electric motor 81 is detachably fastened to the cylinder head 2 by fastening, for example, bolting the bracket member to the cylinder head 2 in the outside of the rocker cover 3.

Particularly, in order that the electric motor 81 may be easily combined to the cylinder head 2, the insert opening 3*a* is formed in a lateral direction in the lateral portion of the cylinder head 2, especially at an endmost point, and the electric motor 81 is placed in the lateral portion of the cylinder head 2 with the mounting bracket 81*b*, especially at the endmost point. The electric motor 81 is mounted on the lateral portion of the cylinder head 2 in consideration of the position of the engine installed in a vehicle.

An outer circumferential surface of the insert portion 81*d*, which faces an inner circumferential surface of the insert opening 3*a*, is attached with a circular oil sealing member 98 (corresponding to the sealing member of the invention) so that the oil sealing member 98 outwardly protrudes from the outer circumferential surface. Because of the oil sealing member 98, the insert portion 81*d* accommodated in the insert opening 3*a* as shown in FIG. 2 elastically contacts the inner circumferential surface of the insert opening 3*a* only with the oil sealing member 98. The other part of the outer circumferential surface of the insert portion 81*d* is spaced from the inner surface of the insert opening 3*a*. Due to the above configuration, vibrations transmitted from the electric motor 81 to the rocker cover 3 are blocked, and the rocker cover does not make motor driving noises. The rocker cover 3 is not applied with great load if the electric motor 81 is installed. Accordingly, there is no affect on surface pressure of a sealing portion between the rocker cover 3 and the cylinder head 2, so that no oil leakage occurs.

Operation of the variable valve train 20 thus constructed will be described below.

Let us suppose that the cam shaft 26 is now driven (rotated) by shaft output of the crank shaft 9, which is transmitted from the timing chain 72 as shown by arrows in FIGS. 1 and 2.

At this moment, the sliding roller 63 of the center rocker arm 60 receives a cam displacement of the intake cam 26*a* as illustrated in FIG. 5. As a result, the valve drive outputs are outputted from the center rocker arm 60. To be concrete, the center rocker arm 60 is oscillated in upward and downward directions along with the cam displacement with the pin 64 used as a supporting point.

The sliding roller 52 of the swing cam 50 receives an oscillation displacement of the center rocker arm 60 through the inclined surface 61*a* that is brought into rotational contact with the sliding roller 52. Therefore, the swing cam 50 repeats oscillation movement in which the swing cam 50 is pushed up and down by the inclined surface 61*a* while rolling along the inclined surface 61*a*. Due to the oscillation of the swing cam 50, the cam surface 51 of the swing cam 50 reciprocates in upward and downward directions.

Since the cam surface 51 is in rotational contact with the needle roller 42 of the rocker arm 40 at this point, the cam surface 51 periodically presses the needle roller 42 with the cam surface 51. In response to the pressing of the needle roller 42, the rocker arm 40 is oscillated with the control shaft 28 used as a supporting point, to thereby open/close a pair of intake valves 14.

The exhaust rocker arms 67 receive the respective exhaust cams 26*b* and are driven according to the cam shape of the cams 26*b*. The exhaust rocker arms 67 are then oscillated with the respective exhaust rocker shafts 27 used as supporting points, to thereby open/close the exhaust valves 15.

Let us suppose that the electric motor 81 is operated to obtain a high valve lift amount according to a command from a controller, not shown. As a result, the rotation of the electric motor 81 is transmitted to the worm shaft gear 84 through the coupling 91, and causes the fan-shaped worm wheel gear 83 engaged with the worm shaft gear 84 to make a swivel displacement (in a direction of high lift in FIG. 2). The rotation of the electric motor 81 is then transmitted to the control shaft 28 while being reduced in speed, and swivels the control shaft 28 up to the point of the required valve properties. Due to the swivel displacement, a bending point of the center rocker arm 60 is displaced. The sliding roller 63 of the center rocker arm 60 is displaced on the intake cam 26*a* along a rotating direction until the cam surface 51 of the swing cam 50 moves into an almost upright position as illustrated in FIG. 5.

Such position of the cam surface 51 sets an area (ratio) in which the needle roller 42 of the cam surface 51 moves back and forth to an area in which the high valve lift amount is obtained. For example, the ratio is set to such ratio that provides the shortest base circle zone and the longest lift zone. By so doing, for example, the intake valve 14 is driven so that a maximum valve lift amount is secured. In other words, the intake valve 14 is driven using the whole area (from the top to the bottom) of the lift zone of the intake cam 26*a*.

Let us suppose that, in order to acquire a low valve lift amount, the electric motor 81 is operated in an opposite direction to when the valve lift is high. As a result, the rotation of the electric motor 81 is transmitted to the worm shaft gear 84 through the coupling 91, and causes the fan-shaped worm wheel gear 83 to make a swivel displacement in an opposite direction (in a low-lift direction as shown in FIG. 2). The rotation of the electric motor 81 is then transmitted to the control shaft 28 while being reduced in speed, and swivels the control shaft 28 up to the point of the required valve properties.

Due to the swivel displacement, the supporting point (pin 64) of the center rocker arm 60 is swiveled and displaced in a direction moving closer to the intake cam 26*a*. The sliding roller 63 of the center rocker arm 60 is displaced on the intake cam 26*a* in the opposite direction to the rotating direction of the intake cam 26*a*. A rotational contact point of the center rocker arm 60 and the intake cam 26*a* moves on the intake cam 26*a* to be deviated in the timing advance direction. Due to this variable of the rotational contact point, a TOP position of a valve lift curve is displaced in the timing advance direction. In response to the displacement of the center rocker arm 60, the inclined surface 61*a* is also displaced in the timing advance direction. As a result of the displacement of the center rocker arm 60, the swing cam 50 moves so that the cam surface 51 is brought into a position inclining downward. As the inclination becomes greater, the area of the cam surface 51 in which the needle roller 42 moves back and forth is changed into such a ratio that the base circle zone becomes longer, and the lift zone becomes shorter. Due to the change of the ratio, the intake valve 14 is gradually transited from the state being driven by using the whole area of the lift zone of the intake cam 26*a* to the state being driven in a limited way by using a part of the lift zone which is displaced to the top.

According to the swivel displacement that is inputted from the control shaft 28, the opening/closing timing and the valve lift amount of the intake valve 14, which are included in the valve drive outputs, are continuously varied while keeping the timing of closing the valve from valve-opening timing that is substantially the same as the maximum valve lift time and greatly changing the valve-closing timing.

While the foregoing operation is repeated, the electric motor 81 of the variable valve train 20 requires maintenance. For example, if the electric motor 81 needs repair or replacement, the mounting bracket 81*b* of the electric motor 81 is loosened, and the insert portion 81*d* is pulled off from the insert opening 3*a* of the rocker cover 3 in an obliquely downward direction. As illustrated in FIG. 7, the insert portion 81*d* is pulled out from the rocker cover 3 together with the second coupling member 91*b*. The electric motor 81 is then removed from the cylinder head 2. The removed electric motor 81 is then repaired or is replaced with a new electric motor 81.

The repaired electric motor 81 or the new electric motor 81 is mounted on the cylinder head 2.

After the second coupling member 91*b* is so positioned as to be smoothly joined to the first coupling member 91*a*, the electric motor 81 is inserted into the insert opening 3*a* of the rocker cover 3 from the second coupling member 91*b* as illustrated in FIG. 7. The second coupling member 91*b* then enters the rocker cover 3. Subsequently, when the insert portion 81*d* reaches the insert opening 3*a*, the insert portion 81*d* is guided by the inner circumferential surface of the insert opening 3*a*, and the electric motor 81 is directed to move toward the first coupling member 91*a* located at the end of the worm shaft gear 84. The second coupling member 91*b* is then guided to the point where the second coupling member 91*b* is engaged with the first coupling member 91*a*. When the electric motor 81 is inserted until the mounting bracket 81*b* reaches the motor mounting face 2*b* of the cylinder head 2, the second coupling member 91*b* and the first coupling member 91*a* are engaged with each other. In short, the connection of the coupling 91 is carried out. Thereafter, when the mounting bracket 81*b* is bolted to the motor mounting face 2*b*, the mounting of the electric motor 81 is completed.

Even if the electric motor 81 is mounted on the cylinder head 2 in a misaligned position, since the coupling 91 has the function of transmitting the rotation while allowing the misalignment, the control rotation of the electric motor 81 is smoothly inputted from the worm shaft gear 84 to the control shaft 28 through the worm wheel gear 84 without causing any impact that forcibly deviates the position of the worm shaft gear 84 (impact that produces excessive friction).

This eliminates troublesome alignment of the axis the worm shaft gear 84 (input shaft) of the worm gear reduction mechanism 82 (transmission mechanism) with respect to that of the output shaft 81*c* of the electric motor 81 at the time of mounting the electric motor 81.

The attachment and detachment of the electric motor 81 can be easily carried out without a concern about an affect on the worm gear reduction mechanism 82 (transmission mechanism). Since the insert opening 3*a* is employed, simply by carrying out the connection of the coupling 91 by inserting the electric motor 81 into the rocker cover 3 and the fixing of the electric motor 81 to the cylinder head 2 from the outside of the rocker cover 3 with the mounting bracket 81*b*, the electric motor 81 can be easily mounted on the cylinder head 2 without the bothersome alignment. Particularly, if the electric motor 81 is mounted on the lateral portion of the cylinder head 2, the mounting of the electric motor 81 can be carried out without difficulty even in a position installed in the vehicle.

The insert portion 81*d* of the electric motor 81, the mounting of which has been finished, has a structure in which only the oil sealing member 98 having elasticity is kept in contact with the inner circumferential surface of the insert opening 3*a*. It is therefore possible to prevent the driving noises of the electric motor 81 and the vibrations of the valve driving from being transmitted to and emitted from the rocker cover 3. Furthermore, there is no adverse affect on sealability between the rocker cover 3 and the cylinder head 2, and engine oil hardly leaks from the insert opening 3*a* at the time of removing the electric motor 81. Consequently, environmental load can be reduced.

The invention is not limited to the one embodiment described above. Various modifications can be made without deviating from the gist of the invention.

For instance, according to the one embodiment, the invention is applied to the variable valve gear that continuously varies the valve properties of the intake valve. However, the invention may be applied to a variable valve train that continuously varies the valve properties of an exhaust valve.

What is claimed is:

1. A variable valve train for an internal combustion engine, comprising:

a variable valve system that is fixed to a cylinder head and implements variable control on valve drive outputs according to displacement that is inputted to a control input member;

a rotation drive source that outputs control rotation for setting valve properties from an output shaft; and a transmission mechanism that is located on the side of the variable valve system, receives the control rotation outputted from the output shaft with an input shaft, and transmits the control rotation to the control input member, wherein the rotation drive source is detachably fixed to an engine body;

the output shaft of the rotation drive source is coupled to the input shaft by using a coupling that moves the output shaft toward the input shaft and disengageably couples the output shaft to the input shaft; and the coupling transmits the rotation of the output shaft to the input shaft while allowing misalignment between the output shaft and the input shaft.

2. The variable valve train for an internal combustion engine according to claim 1, wherein the coupling is set in an internal space enclosing a rocker cover and the cylinder head.

3. The variable valve train for an internal combustion engine according to claim 1, wherein the coupling includes a first coupling member that is attached to the input shaft of the transmission mechanism and a second coupling member that is attached to the output shaft of the rotation drive source and is engaged with the first coupling member when the rotation drive source is fixed to the engine body;

the first coupling member is attached to the input shaft so as to be displaceable along one radial direction in relation to the input shaft, and the second coupling member along one radial direction in relation to the output shaft; and when the first coupling member is engaged with the second coupling member, the one radial direction of the first coupling member does not coincide with the one radial direction of the second coupling member.

4. The variable valve train for an internal combustion engine according to claim 3, wherein the first coupling member is attached to the input shaft so as to be tiltable around the one radial direction of the input shaft, and the second coupling member is attached to the output shaft so as to be tiltable around the one radial direction of the output shaft; and when the first coupling member is engaged with the second coupling member, the one radial direction of the first coupling member does not coincide with the one radial direction of the second coupling member.

5. The variable valve train for an internal combustion engine according to claim 1, wherein a rocker cover has an insert opening into which an output-shaft side of the rotation drive source can be inserted from the outside of the rocker cover; and the rotation drive source has an inserted portion that is guided by the insert opening so that an end portion of the output shaft is engaged with an end portion of the input shaft of the transmission mechanism when the output-shaft side is inserted from the insert opening into the rocker cover.

6. The variable valve train for an internal combustion engine according to claim 5, wherein the rotation drive source has a fixed portion that is fixed to the cylinder head for fixing the rotation drive source to the engine body; and the insert portion has a sealing member that elastically contacts an inner circumferential surface of the insert opening.

7. The variable valve train for an internal combustion engine according to claim 1, wherein the rotation drive source is fixed to a lateral portion of the cylinder head.

* * * * *